US006357477B1

(12) United States Patent
Walcott et al.

(10) Patent No.: US 6,357,477 B1
(45) Date of Patent: Mar. 19, 2002

(54) BYPASS ASSEMBLY INCORPORATING DOUBLE STREET T-FITTING AND METHOD OF MAKING THE SAME

(76) Inventors: Ross Walcott; Ryal Walcott, both of 4001 Milton Ave., Janesville, WI (US) 53546

( * ) Notice: Subject to any disclaimer, the term of this patent is extended or adjusted under 35 U.S.C. 154(b) by 0 days.

(21) Appl. No.: 09/538,083

(22) Filed: Mar. 29, 2000

(51) Int. Cl.[7] ..... F16K 11/20
(52) U.S. Cl. ..... 137/599.15
(58) Field of Search ..... 137/599.14, 599.15

(56) References Cited

U.S. PATENT DOCUMENTS

| | | | | |
|---|---|---|---|---|
| 723,675 A | | 3/1903 | Johnson | |
| 1,146,663 A | | 7/1915 | Stetter | |
| 1,559,706 A | | 11/1925 | Jennings | |
| 1,759,321 A | | 5/1930 | Oldfield | |
| 1,929,434 A | | 10/1933 | Kocher | |
| 2,083,966 A | | 6/1937 | Stitzer | |
| 2,525,399 A | | 10/1950 | Collison | |
| 2,660,195 A | * | 11/1953 | Risley et al. | 137/599.15 X |
| 3,458,619 A | | 7/1969 | Prochaska | |
| 3,460,566 A | * | 8/1969 | Heartstedt | 137/599.15 X |
| 3,685,542 A | | 8/1972 | Daughirda | |
| 3,894,719 A | | 7/1975 | Horvath et al. | |
| 4,070,044 A | | 1/1978 | Carrow | |
| 4,242,201 A | | 12/1980 | Stephens et al. | |
| 4,320,003 A | | 3/1982 | Sanderson et al. | |
| 5,910,244 A | | 6/1999 | Stamos et al. | |

* cited by examiner

*Primary Examiner*—S Hepperle
(74) *Attorney, Agent, or Firm*—Jansson, Shupe & Munger, Ltd

(57) ABSTRACT

A bypass assembly is provided for bypassing a water softener. The bypass assembly includes a bypass valve, a shut off valve at the input to the water softener, and a shut off valve at the output of the water softener. The shut off valves are positioned between the bypass valve and the tank of the water softener. A t-shaped fitting is used to interconnect the water supply, bypass valve and first shut-off valve and a second t-shaped fitting is used to interconnect the water discharge port, the bypass valve and the second shut-off valve. The t-shaped fittings are provided with double street ends to facilitate interconnection of the t-shaped fittings to corresponding valves.

24 Claims, 3 Drawing Sheets

BYPASS ASSEMBLY INCORPORATING DOUBLE STREET T-FITTING AND METHOD OF MAKING THE SAME

FIELD OF THE INVENTION

This invention relates generally to bypass assemblies, and in particular, to a bypass assembly for a water softener which incorporates a double street t-fitting and a method of making the same.

BACKGROUND AND SUMMARY OF THE PRESENT INVENTION

As is known, household water is not pure. Contaminates such as minerals, metals and the like may be found therein. While many of such contaminates are harmless, introduction of minerals such as calcium and magnesium tend to cause scale to form in hot water pipes and water heaters. Further, these types of minerals tend to interfere with the cleaning action of soaps and detergents and form a film on skin, clothing, etc. In order to remove these types of minerals from a household water supply, a water softener is typically used.

Water softeners remove calcium, magnesium and other positively charged metals by saturating such metals with sodium from a salt solution. As the household water passes through the salt solution, the sodium in the solution exchanges with the calcium and the magnesium in the household water. While the water softeners are generally successful at removing calcium and magnesium from the household water, the water softeners introduce sodium into the household water. Therefore, for people who are a low sodium diet, drinking softened water may be unhealthy. Further, users of softened water often complain about the difficulty in removing soap off the person during washing. In view of the foregoing, it is highly desirable to provide a bypass assembly which allows a user to bypass the water softener when desired or when repairs are necessary.

Prior bypass assemblies typically incorporate a bypass valve, a shut-off valve at the input to the water softener and a shut off valve at the output of the water softener. The shut off valves are positioned between the bypass valve and the tank of the water softener. A t-shaped fitting is used to interconnect the water inlet, bypass valve and first shut off valve. Similarly, a t-shaped fitting is used to interconnect the water discharge port, the bypass valve, and the second shut off valve. However, the ends of prior art t-shaped fittings typically are formed as coupling ends. As such, prior art t-shaped fittings cannot be connected directly to the valves and requires lengths of tubing to be connected at both the t-fitting and the valve. Such additional connections are time consuming and add additional costs to the bypass assembly.

Therefore, it is an object and feature of the present invention to provide a bypass assembly which incorporates a t-shaped fitting which is easily and simply connected to corresponding valves in the bypass assembly.

It is a further object and feature of the present invention to provide a bypass assembly which incorporates a t-shaped fitting which is simple and inexpensive to manufacture.

It is a still further object and feature of the present invention to provide a method of making a bypass assembly which is less time consuming than prior art methods.

In accordance with the present invention, a bypass assembly is provided for bypassing a water softener having an input and an output. The bypass assembly includes a first flow valve having an input and an output connectable to the input of the water softener. The first flow valve is movable between a first open position allowing for the flow of water between the input and the output of the first flow valve and a second closed position preventing the flow of water between the input and the output of the first flow valve. A second flow valve is also provided. The second flow valve includes an output and an input connectable to the output of the water softener. The second flow valve is movable between a first open position allowing the flow of water between the input and the output of the second flow valve and a second closed position preventing flow of water between the input and the output of the second flow valve. A bypass valve is also provided. The bypass valve has an input and an output and is movable between the first open position allowing for the flow of water between the input and the output of the bypass valve and a second closed position preventing the flow of water between the input and the output of the bypass valve. The first t-shaped fitting has an input connectable to a water source; a first leg terminating at a street end receivable in the input of the bypass valve; and a second leg terminating at the street end receivable in the input of the first closed valve. A second t-shaped fitting has an output to discharge water flowing therethrough; a first leg terminating at the street end receivable in the output of the second flow valve, and a second leg terminating at the street end receivable in the output of the bypass valve.

It is contemplated that the bypass assembly further include a first elbow having an input end operatively connected to the output of the first flow valve and an output end connectable to the input of the water softener. The input end of the first elbow is a street end and the output end of the elbow is a street end. The input end of the first elbow is slidably received within the output of the first flow valve and the output end of the first elbow is slidable within the input of the water softener so as to allow the first flow valve to be positioned in a user selected position with respect to the water softener.

In addition, a second elbow is provided having an input end connectable to the output of the water softener and an output end operatively connected to the input end of the second flow valve. The input end of the second elbow is a street end and the output end of the second elbow is a street end. The input end of the second elbow is slidable within the output of the water softener and the output end of the second elbow is slidably received in the input of the second flow valve so as to allow for the second flow valve to be positioned in a user selected position with respect to the water softener.

The street end of the first leg of the first t-shaped fitting is slidably received within the input of the bypass valve and the street end of the second leg of the first t-shaped fitting is slidably received within the input of the first flow valve so as to allow for the first t-shaped fitting to be positioned at a user selected position with respect to the bypass valve and the first flow valve. Similarly, the street end of the first leg of the second t-shaped fitting is slidably received within the output of the second flow valve and the street end of the second leg of the second t-shaped fitting is slidably received within the output of the bypass valve so as to allow for the second t-shaped fitting to be positioned at a user selected position with respect to the bypass valve and the second flow valve.

In accordance with a still further aspect of the present invention, an improvement in a bypass assembly is provided. The bypass assembly allows for the bypassing of a water softener having an input and an output. The bypass assembly has a first flow valve having an input and an output operatively connected to the input of the water softener, a second flow valve having an output and an input operatively connected to the output of the water softener; and a bypass valve having an input and an output. The improvement includes a t-shaped fitting having an input connectable to a water source; a first leg terminating at a street end slidably received within the input of the bypass valve, and a second leg terminating at a street end slidably received within the input of the first flow valve so as to allow the first t-shaped fitting to be in position at a user selected position with respect to the bypass valve and the first flow valve.

The improvement may also include a second t-shaped fitting having an output to discharge water flowing through the bypass assembly; a first leg terminating in a street end slidably received within the output of the second flow valve; and a second leg terminating at a street end slidably received within the output of the bypass valve so as to allow for the second t-shaped fitting to be positioned at a user selected position with respect to the bypass valve and the second flow valve.

The improvement further includes a first elbow having an input and operatively connected to the output of the first flow valve and an output end connectable to the input of the water softener. The input end of the first elbow is a street end and the output end of the first elbow is a street end. The input end of the first elbow is slidably received within the output of the first flow valve and the output end of the first elbow is slidable within the input of the water softener so as to allow for the first flow valve to be positioned at a user selected position with respect to the water softener.

Similarly, a second elbow is also provided. The second elbow has an input end connectable to the output of the water softener and an output operatively connected to the input of the second flow valve. The input end of the second elbow is a street end and the output end of the second elbow is a street end. The input end of the second elbow is slidable within the output of the water softener and the output end of the second elbow is slidably received within the input of the second flow valve so as to allow for the second flow valve to be positioned at a user selected position with respect to the water softener. It is contemplated that a portion of the street end of the first leg and a portion of the street end of the second leg may be removed to facilitate the positioning of the first t-shaped fitting in the user selected position with respect to the bypass valve and the first flow valve.

In accordance with a still further aspect of the present invention, a method is provided for making a bypass assembly for bypassing a water softener having an input and an output. The method includes the steps of providing a first flow valve having an input and an output for connection to the input of the water softener and providing a bypass valve having an input and an output. The input of the first flow valve is interconnected to a first street end of a first t-shaped fitting. The input of the bypass valve is interconnected to a second street end of the first t-shaped fitting. The input of the first input t-shaped fitting may be connected to a water source.

The step of interconnecting the input of the first flow valve to the first street end of the first t-shaped fitting may include the steps of removing the portion of the first end from the first t-shaped fitting and inserting the first street end of the first t-shaped fitting into the input of the first flow valve. The step of interconnecting the input of the bypass valve to the second street end of the first t-shaped fitting may include the steps of removing a portion of the second street end of the first t-shaped fitting and inserting the second street end of the first t-shape fitting to the input of the bypass valve.

It is contemplated that the method includes the additional steps of providing a second flow valve having an input for connection to the output of the water softener and an output. The output of the second flow valve is interconnected to a first street end of a second t-shaped fitting and the output of the bypass valve is interconnected to a second street end of the second t-shaped fitting. The output of the second t-shaped fitting may be connected to a water discharge port.

The step of interconnecting the output of the second flow valve to the first street end of the second t-shaped fitting may include the step of removing a portion of the first street end of the second t-shaped fitting and inserting the first street end of the second t-shaped fitting into the output of the second flow valve. The step of interconnecting the output of the bypass valve to the second street end of the second t-shaped fitting may include the steps of removing a portion of the second street end of the second t-shaped valve and inserting the second street end of the second t-shaped fitting into the output of the bypass valve.

In accordance with a still further aspect of the present invention, a fitting for a bypass assembly is provided. The fitting includes a first, generally hollow tube defining a fluid passageway therethrough and terminating at a street end. The fitting also includes a second generally hollow tube defining a fluid passageway therethrough and terminating at a street end, and a third generally hollow tube defining a fluid passageway therethrough. A valve controls the flow of fluid through the fitting. The valve is movable between a first position wherein the fluid passageway in the first tube and the fluid passageway in the third tube are in communication, and a second position wherein the fluid passageway in the second tube and the fluid passageway in the third tube are in communication. It is contemplated that the third tube terminate at a coupling end. It is further contemplated that the first tube have an initial length, but a portion of the street end of the first tube may be removed to reduce the length thereof.

BRIEF DESCRIPTION OF THE DRAWINGS

The drawings furnished herewith illustrate a preferred construction of the present invention in which the above advantages and features are clearly disclosed as well as others which will be readily understood from the following description of the illustrated embodiment.

In the drawings.

DETAILED DESCRIPTION OF THE DRAWINGS

Figure 1:
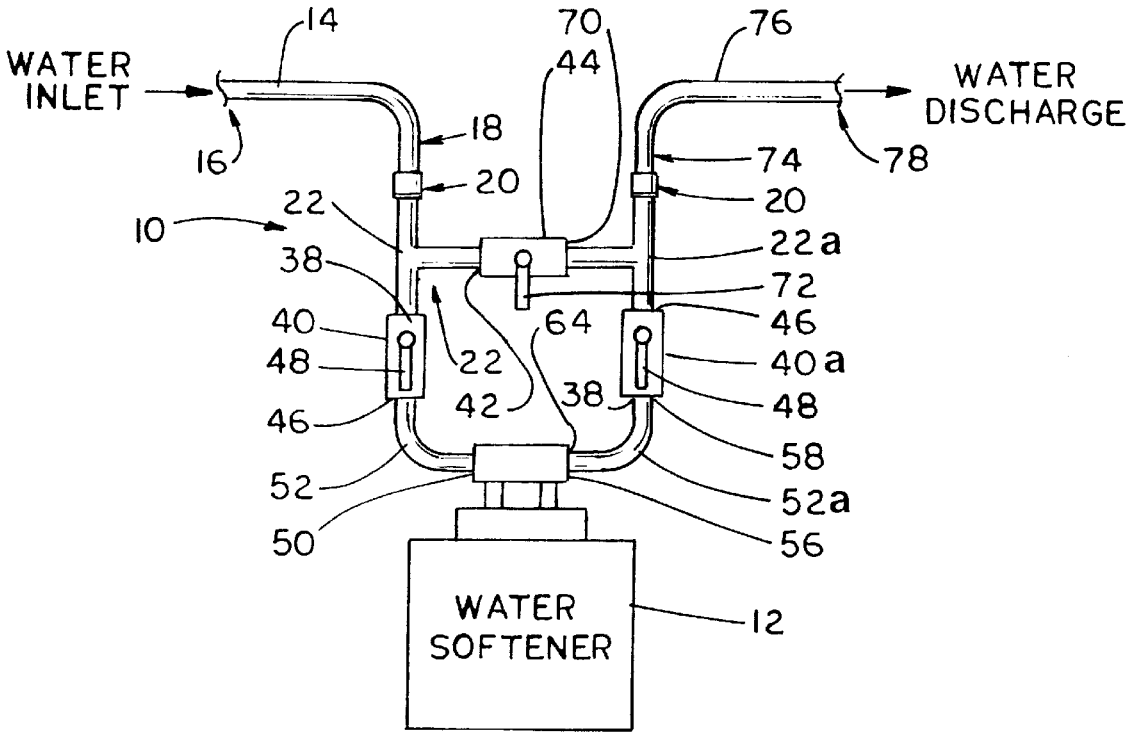
FIG. 1 is a front elevational view of a bypass assembly in accordance with the present invention interconnected to a water softener.
Figure 2:
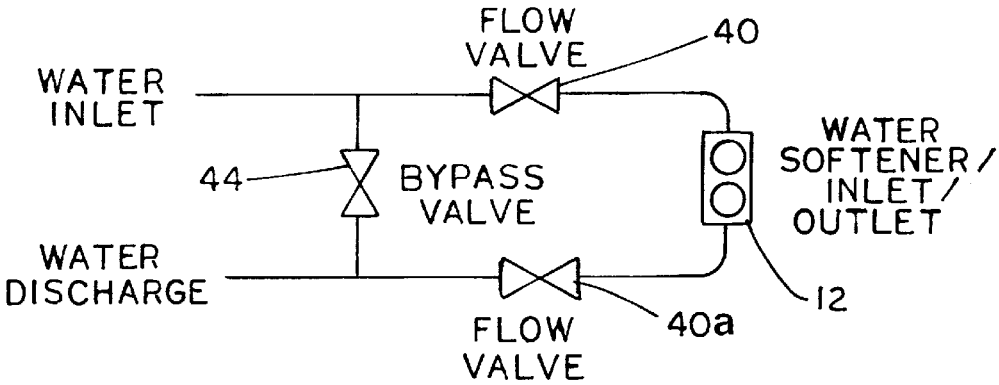
FIG. 2 is a schematic view of the bypass assembly and the water softener of FIG. 1.

Referring to FIGS. 1–2, a bypass assembly in accordance with the present invention is generally designated by the reference numeral 10. As hereinafter described, bypass assembly 10 is intended to be operatively connected to a water softener 12 in order to allow a user to bypass water softener 10 when desired. However, it is contemplated as being within the scope of the present invention to interconnect bypass assembly 10 in connection with other types of fluid treatment apparatus in order to allow a user to bypass such fluid treatment apparatus when desired.

Figure 3:
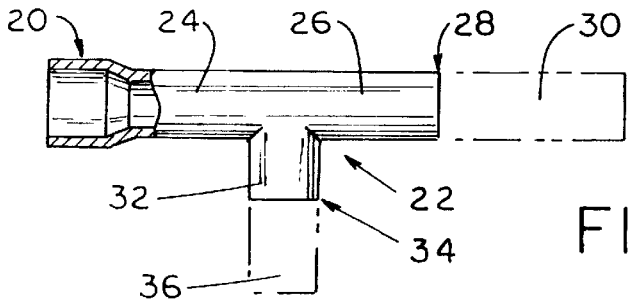
FIG. 3 is a side elevational view, partially in section, showing a double street t-fitting for use in the bypass assembly of the present invention.

Bypass assembly 10 includes a water inlet tube 14 having a first end 16 connectable to a water inlet source and a second end 18 receivable within coupling end 20 of a double street t-fitting generally designated by the reference number 22. As best seen in FIG. 3, coupling end 20 is positioned at the end of first leg 24 of t-fitting 22. Leg 24 is generally hollow and extends along a longitudinal axis. T-fitting 22 further includes a second leg 26 which is generally hollow and also lies on the longitudinal axis of first leg 24. Second leg 26 of t-fitting 22 has an interior which communicates with the interior of first leg 24 of t-fitting 22. Second leg 26 terminates at a street end 28. A portion 30, shown in phantom in FIG. 3, of street end 28 of first leg 24 may be removable for reasons hereinafter described.

T-shaped fitting 22 further includes a third leg 32 which is generally perpendicular on longitudinal axis of first and second legs 22 and 24, respectively. Third leg 32 includes an interior which communicates with the interior of first and second legs 24 and 26, respectively. Similar to second leg 26, third leg 32 terminates at a street end 34. It is contemplated that a portion 36, shown in phantom in FIG. 3, of street end 34 of third leg 32, may be removeable for reasons hereinafter described.

Street end 28 of second leg 26 of t-shaped fitting 22 is slidably receivable within the input 38 of a first flow valve 40. The street end 34 of third leg 32 of t-shaped fitting 22 is receivable within the input 42 of bypass valve 44. First flow valve 40 also includes an output 46 and a handle 48. As is conventional, handle 48 of first flow valve 40 is movable between a first open position allowing for the flow of fluid between input 38 and output 46 of first flow valve 40 and a closed position which prevents the flow of fluid between input 38 and output 46 of first flow valve 40.

Figure 4:
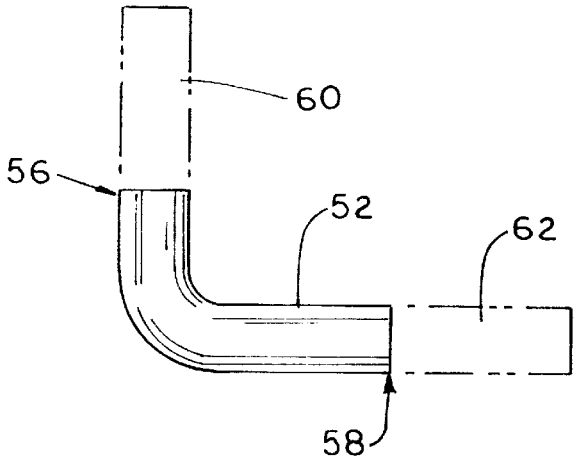
FIG. 4 is a side elevational view showing an elbow for use in the bypass assembly of the present invention.

Output 46 of first flow valve 40 is interconnected to input 50 of water softener 12 by an elbow 52. Referring to FIG. 4, elbow 52 is generally hollow and includes a first street end 56 and a second street end 58. It is contemplated that a portion 60, shown in phantom in FIG. 4, of street end 56 of elbow 52 may be removable, for reasons hereinafter described. Similarly, a portion 62, shown in phantom in FIG. 4 of street end 58 of elbow 52, may be removable for reasons hereinafter described, Street end 56 of elbow 52 may be slidably received within output 46 of first flow valve 40 and street end 58 of first elbow 52 may be slidably received within input 50 of water softener 12 so as to operatively connect first flow valve 40 and water softener 12.

Bypass assembly 10 further includes a second elbow **52*a*. Second elbow 52*a* is identical in structure to first elbow 52, and as such, the description heretofore with respect to first elbow 52, is understood to describe second elbow 52*a*, as if fully described herein. Street end 56 of second elbow 52*a* is slidably received within output 64 of water softener 12. Street end 58 of second elbow 54*a* is slidably received within the input 38 of second flow valve 40*a***.

Second flow valve **40*a* is identical in structure to first flow valve 40, and as such, the prior description of first flow valve 40 is understood to describe second flow valve 40*a***, as if fully described herein.

Bypass assembly 10 further includes a second t-shaped fitting **22*a*. Second t-shaped fitting 22*a* is identical in structure to first flow valve 22, and as such, the description heretofore of first flow valve 22 is understood to describe the structure of second flow valve 22*a*** as if fully described herein.

Street end 28 of second leg 26 of second t-shaped fitting **22*a* is slidably received within the output 46 of second flow valve 40*a*. Street end 34 of third leg 32 of second t-shaped fitting 22*a* is slidably received within output 70 of bypass valve 44. As is conventional, bypass valve 44 includes a handle 72 which is movable between a first position which allows the flow of fluid between input 42 and output 70 thereof and a second closed position which prevents the flow of fluid between input 42 and output 70 thereof. Coupling end 20 of second t-shaped fitting 22*a* is interconnected to the input end 74 of a water discharge tube 76. Discharge end 78 of discharge tube 76** is operatively connected to a water discharge port.

In a non-bypass configuration, handles 48 of first and second flow valves 40 and **40*a*, respectively, are moved to the opened position so as to allow water to pass through first and second flow valves 40 and 40*a*, respectively. Handle 72 of bypass valve 44 is moved to the closed position so as to prevent a flow of water therethrough. As described, water from the inlet source passes through inlet tube 14 into first t-fitting 22 through coupling end 20. With handle 72 of bypass valve 44 in the closed position, the water entering coupling end 20 of first leg 24 of first t-fitting 22 flows into the input 38 of first flow valve 40 through street end 28 of second leg 26 of first t-fitting 22. The water flows through first flow valve 40 and out output 46, and continues to flow to the input 50 of water softener 12 through first elbow 52**.

Water passes through water softener 12 and is softened in a conventional manner. The softened water passes out of output 64 of water softener 12 into the input 38 of second flow valve **40*a* through second elbow 52*a*. With handle 48 of second flow valve 40*a* in the opened position, water passes through second flow valve 40*a* and out of output 46 into second t-fitting 22*a*. With handle 72 of bypass valve 44 in the closed position, water flows toward the water discharge port and out of coupling end 20 of second t-fitting 22*a*. The water then flows through water discharge tube 76 from input end 74 to discharge end 78** thereof.

Alternatively, in order to bypass water softener 12, handles 48 of first and second flow valves 40 and **40*a*, respectively, are moved to the closed positions so as to prevent the flow of water therethrough. Handle 72 of bypass valve 44** is moved to the opened position so as to allow for the flow of water therethrough.

In such bypass configuration, water entering the coupling end 20 of first leg 24 of first t-fitting 22 is directed into input 42 of bypass valve 44 from street end 34 of third leg 32 of t-fitting 22. Water flows out of bypass valve 44 through output 70 and into street end 46 of third leg 44 of second t-fitting **22*a***. The water continues toward the water discharge port, as heretofore described with respect to the non-bypass configuration.

Referring to FIGS. **5*a* and 5*b*, often times the positions of first and second flow valve 40 and 40*a*, respectively, and of bypass valve 44 are dictated by the space available for bypass assembly 10 and/or the position of water softener 12. By way of example, referring to FIG. 5*b*, portions 30 of second legs 28 of first and second t-fittings 22 and 22*a*, respectively, are removed and portions 36 of third legs 32 of first and second t-fittings 22 and 22*a*, respectively, are removed. As a result, first and second t-fittings 22 and 22*a*, respectively, allow for bypass assembly 10 to be assembled, as heretofore described, in tighter surroundings. Further, since second and third legs 28 and 32, respectively, of first and second t-fittings 22 and 22*a*, respectively, terminate at street ends, street ends 28 and 34 of second and third legs 28** and 32, respectively, may be inserted within corresponding inputs/outputs of first and second flow valves 40 and 40*a*, respectively, and bypass valve 44 without any additional couplings or the like.

Similarly, portions 60 of street ends 56 of first and second elbows 52 and 52*a*, respectively, may be removed and portions 62 of street ends 58 of first and second elbows 52 and 52*a*, respectively, may be removed. As a result, first and second flow valves 40 and 40*a*, respectively, may be positioned with respect to water softener 12 and street ends 56 and 58 of first and second elbows 52 and 52*a* may be interconnected to the inputs/outputs of first and second flow valves 40 and 40*a*, respectively, and water softener 12 without need for any additional couplings or the like.

Figure 5A:
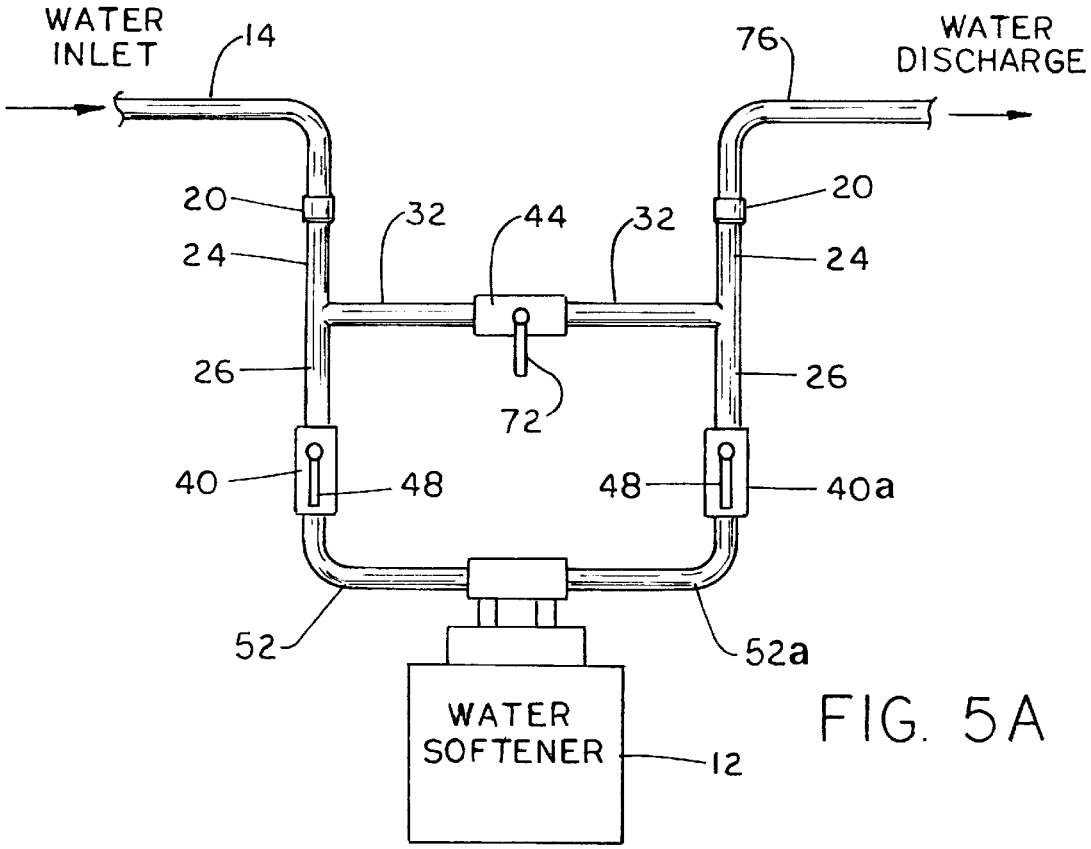
FIGS. 5A and 5B are front elevational views, similar to FIG. 1, showing the bypass assembly of the present invention interconnected to a water softener.
Figure 5B:
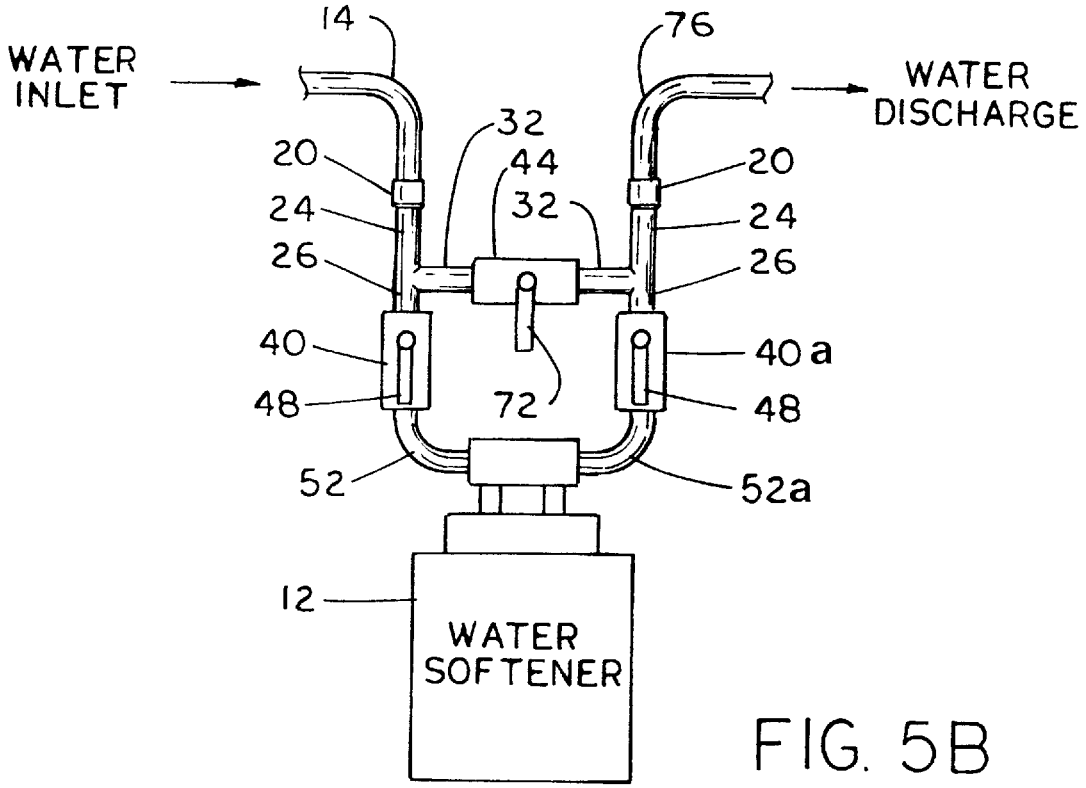

Referring to FIG. 5*a*, in surroundings which are not limited, portions 30 of first legs 26 of first and second t-fittings 22 and 22*a*, respectively, and portions 36 of third legs 32 of first and second t-fittings 22 and 22*a*, respectively, need not be removed. Similarly, portions 60 of street ends 56 of first and second elbows 52 and 52*a*, respectively, and portion 62 of street ends 58 of first and second elbows 52 and 52*a*, respectively, need not be removed. As described, street ends 28 and 34 of first and second t-fittings 22 and 22*a*, respectively, and street ends 56 and 58 of first and second elbows 52 and 52*a* may be interconnected to corresponding inputs/outputs of first and second flow valves 40 and 40*a*, respectively; bypass valve 44; and water softener 12 without any need for additional couplings or the like.

Various modes of carrying out the invention are contemplated as being within the scope of the following claims particularly pointing out and distinctly claiming the subject matter which is regarded as the invention.

We claim:

1. A bypass assembly for bypassing a water softener having an input and an output, comprising:

a first flow valve having an input and an output connectable to the input of the water softener, the first flow valve movable between a first open position allowing for the flow of water between the input and the output of the first flow valve and a second closed position preventing the flow of water between the input and the output of the first flow valve;

a second flow valve having an output and an input connectable to the output of the water softener, the second flow valve movable between a first open position allowing for the flow of water between the input and the output of the second flow valve and a second closed position preventing the flow of water between the input and the output of the second flow valve;

a bypass valve having an input and an output, the bypass valve movable between a first open position allowing for the flow of water between the input and the output of the bypass valve and a second closed position preventing the flow of water between the input and the output of the bypass valve;

a first t-shaped fitting having an input connectable to a water source, a first leg terminating at an end dimensioned to be directly receivable in the input of the bypass valve and a second leg terminating at an end dimensioned to be directly receivable in the input of the first flow valve; and a second t-shaped fitting having an output to discharge water flowing therethrough, a first leg terminating at an end dimensioned to be directly receivable in the output of the second flow valve, and a second leg terminating at an end dimensioned to be directly receivable in the output of the bypass valve.

2. The bypass assembly of claim 1 further comprising a first elbow having an input end operatively connected to the output of the first flow valve and an output end connectable to the input of the water softener.

3. The bypass assembly of claim 2 wherein the input end of the first elbow is dimensioned to be directly receivable in the output of the first flow valve and the output end of the first elbow is dimensioned to be directly receivably in the input of the water softener.

4. The bypass assembly of claim 3 wherein the input end of the first elbow is slidably received within the output of the first flow valve and wherein the output end of the first elbow is slidable within the input of the water softener so as to allow for the first flow valve to be positioned at a user selected position with respect to the water softener.

5. The bypass assembly of claim 4 further comprising a second elbow having an input end connectable to the output of the water softener and an output end operatively connected to the input of the second flow valve.

6. The bypass assembly of claim 5 wherein the input end of the second elbow is dimensioned to be directly receivable in the output of the water softener and the output end of the second elbow is dimensioned to be directly receivable in the input of the second flow valve.

7. The bypass assembly of claim 6 wherein the input end of the second elbow is slidable within the output of the water softener and wherein the output end of the second elbow is slidably received within the input of the second flow valve so as to allow for the second flow valve to be positioned at a user selected position with respect to the water softener.

8. The bypass assembly of claim 1 wherein the end of the first leg of the first t-shaped fitting is slidably received within the input of the bypass valve and wherein the end of the second leg of the first t-shaped fitting is slidably received within the input of the first flow valve so as to allow for the first t-shaped fitting to be positioned at a user selected position with respect to the bypass valve and the first flow valve.

9. The bypass assembly of claim 8 wherein the end of the first leg of the second t-shaped fitting is slidably received within the output of the second flow valve and wherein the end of the second leg of the second t-shaped fitting is slidably received within the output of the bypass valve so as to allow for the second t-shaped fitting to be positioned at a user selected position with respect to the bypass valve and the second flow valve.

10. In a bypass assembly for bypassing a water softener having an input and an output, the bypass assembly having a first flow valve having an input and an output operatively connected to the input of the water softener, a second flow valve having an output and an input operatively connected to the output of the water softener, and a bypass valve having an input and an output, the improvement comprising:

a first t-shaped fitting having an input connectable to a water source, a first leg terminating at an end slidably received within the input of the bypass valve and a second leg terminating at an end slidably received within the input of the first flow valve so as to allow the first t-shaped fitting to be positioned at a user selected position with respect to the bypass valve and the first flow valve.

11. The improvement of claim 10 further comprising:

a second t-shaped fitting having an output to discharge water flowing through the bypass assembly, a first leg terminating at an end slidably received within the output of the second flow valve, and a second leg terminating at an end slidably received within the output of the bypass valve so as to allow for the second t-shaped fitting to be positioned at a user selected position with respect to the bypass valve and the second flow valve.

12. The improvement of claim 11 further comprising a first elbow having an input end operatively connected to the output of the first flow valve and an output end connectable to the input of the water softener.

13. The improvement of claim 12 wherein the input end of the first elbow is dimensioned to be directly receivable in the output of the first flow valve and the output end of the first elbow is dimensioned to be directly receivable in the input of the water softener.

14. The improvement of claim 13 wherein the input end of the first elbow is slidably received within the output of the first flow valve and wherein the output end of the first elbow is slidable within the input of the water softener so as to allow for the first flow valve to be positioned at a user selected position with respect to the water softener.

15. The improvement of claim 14 further comprising a second elbow having an input end connectable to the output of the water softener and an output end operatively connected to the input of the second flow valve.

16. The improvement of claim 15 wherein the input end of the second elbow is dimensioned to be directly receivable in the output of the water softener and the output end of the second elbow is dimensioned to be directly receivable in the input of the second flow valve.

17. The improvement of claim 16 wherein the input end of the second elbow is slidable within the output of the water softener and wherein the output end of the second elbow is slidably received within the input of the second flow valve so as to allow for the second flow valve to be positioned at a user selected position with respect to the water softener.

18. The improvement of claim 10 wherein a portion of the end of the first leg and a portion of the end of the second leg may be removed to facilitate the positioning of the first t-shaped fitting of the user selected position with respect to the bypass valve and the first flow valve.

19. A method of making a bypass assembly for bypassing a water softener having an input and an output, comprising the steps of:

providing a first flow valve having an input and an output for connection to the input of the water softener, and a bypass valve having an input and an output;

interconnecting the input of the first flow valve to a first end of a first t-shaped fitting, the first end being dimensioned so that it is directly receivable within the input of the first flow valve;

interconnecting the input of the bypass valve to a second end of the first t-shaped fitting, the second end being dimensioned so that it is directly receivable within the input of the input of the bypass valve; and providing an input for the first t-shaped fitting for connection to a water source.

20. The method of claim 19 wherein the step of interconnecting the input of the first flow valve to the first end of the first t-shaped fitting includes the steps of:

removing a portion of the first end of the first t-shaped fitting; and inserting the first end of the first t-shaped fitting into the input of the first flow valve.

21. The method of claim 19 wherein the step of interconnecting the input of the bypass valve to the second end of the first t-shaped fitting includes the steps of:

removing a portion of the second end of the first t-shaped fitting; and inserting the second end of the first t-shaped fitting into the input of the bypass valve.

22. The method of claim 19 comprising the additional steps:

providing a second flow valve having an input for connection to the output of the water softener and an output;

interconnecting the output of the second flow valve to a first end of a second t-shaped fitting, the first end of the second t-shaped fitting being dimensioned so that it is directly receivable within the output of the second flow valve;

interconnecting the output of the bypass valve to a second end of the second t-shaped fitting, the second end of the second t-shaped fitting being dimensioned so that it is directly receivable within the output of the bypass valve; and providing an output for the second t-shaped fitting for connection to a water discharge port.

23. The method of claim 22 wherein the step of interconnecting the output of the second flow valve to the first end of a second t-shaped fitting includes the steps of:

removing a portion of the first end of the second t-shaped fitting; and inserting the first end of the second t-shaped fitting into the output of the second flow valve.

24. The method of claim 22 wherein the step of interconnecting the output of the bypass valve to the second end of the second t-shaped fitting includes the steps of:

removing a portion of the second end of the second t-shaped fitting; and inserting the second end of the second t-shaped fitting into the output of the bypass valve.

* * * * *